United States Patent [19]

Billing et al.

[11] Patent Number: 4,607,192

[45] Date of Patent: Aug. 19, 1986

[54] PRE-FOCUSSED INCANDESCENT LAMPS AND METHOD OF ASSEMBLING BASE THEREOF

[75] Inventors: Alfred G. Billing, Loughborough; Norman Burgess, Melton Mowbray, both of England

[73] Assignee: Thorn EMI plc, London, England

[21] Appl. No.: 554,232

[22] Filed: Nov. 22, 1983

[30] Foreign Application Priority Data

Nov. 23, 1982 [GB] United Kingdom ..... 8233369

[51] Int. Cl.[4] ..... H01J 9/34

[52] U.S. Cl. ..... 313/579; 313/318; 445/3; 445/27

[58] Field of Search ..... 445/3, 4, 27, 44, 22, 445/29; 313/318, 579

[56] References Cited

U.S. PATENT DOCUMENTS 1,760,693 5/1930 Gustin ..... 445/4 X
1,813,572 7/1931 Gustin ..... 313/318 X
3,188,728 6/1965 Perrin ..... 29/229
4,496,874 1/1985 Sanders et al. ..... 313/318

FOREIGN PATENT DOCUMENTS 767971 2/1957 United Kingdom .
881106 11/1961 United Kingdom ..... 313/318

*Primary Examiner*—Kenneth J. Ramsey
*Attorney, Agent, or Firm*—Fleit, Jacobson, Cohn & Price

[57] ABSTRACT

The invention provides an improved method of construction of a prefocus lamp, to improve positioning of the filament relative to the lamp cap, and a lamp so made. The lamp envelope has a pinch seal with V-shaped grooves into which a resilient ring is sprung. This assembly is a sliding fit in the lamp cap and is slid therein to have substantially only line contact between the ring and the cap. The envelope can then be relatively easily rocked and otherwise moved in the lamp cap to be precisely positioned. When the positioning is complete solder previously placed in the cap is melted, the position being such that it flows over the ring and fixes the ring to the lamp cap.

18 Claims, 6 Drawing Figures

PRE-FOCUSSED INCANDESCENT LAMPS AND METHOD OF ASSEMBLING BASE THEREOF

Figure 1:
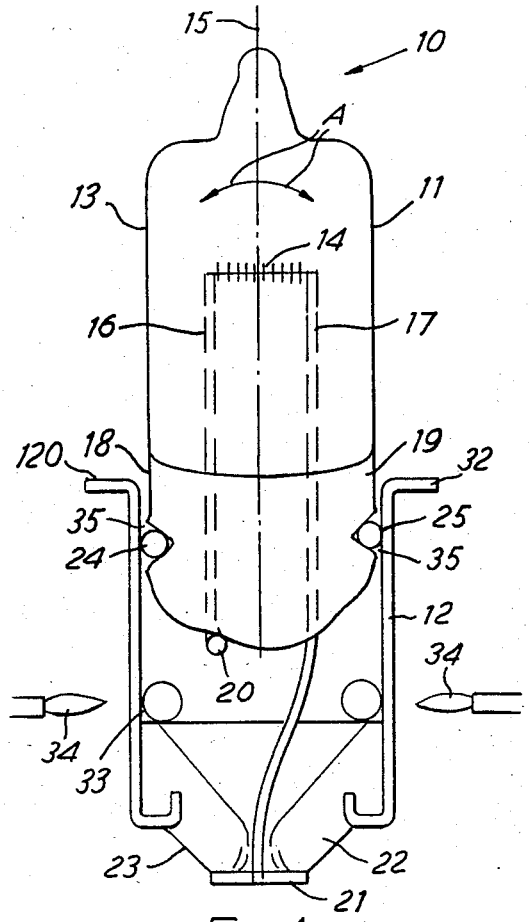

This invention relates to incandescent lamps. More particularly the invention relates to incandescent lamps which operate on the tungsten halogen cycle and which are of the pre-focussed type, that is to say, the lamp is designed to be used in a reflector or projector so that it is important that the lamp filament be in correct alignment with both the optical axis and the focal point of the reflector or projector. In practice the lamp cap is held in a predetermined position and the lamp bulb is then assembled to the lamp cap and its position adjusted until the filament is in the correct alignment, that is, the pre-focussed position. Once this position has been achieved the bulb is fixed in position within the lamp cap. Of course, it will be appreciated that this procedure is usually carried out on fully automated machinery designed for high speed production.

The distinction between such a pre-focus lamp for use in projection and reflection apparatus and an ordinary general service incandescent (GLS) lamp should be clearly appreciated. A GLS lamp has a large ring shaped filament inside a relatively large glass envelope and there is no need to position the filament within the envelope to any exact limits. By contrast pre-focus lamps, the subject of the present invention, have to be positioned precisely in order to co-operate properly with the projective optics. For example, the filament of a pre-focus lamp in a typical example has to be positioned so that its centre is within 0.3 mm of a prescribed point on the optical axis of the reflector. Moreover the lamp cap of a prefocus lamp is designed to have special provision to assist in its location within the reflector.

In the present design of such a lamp it is difficult to adjust the position of the lamp bulb within the lamp cap.

An object of this invention is to provide an improved design of a pre-focussed lamp such that this problem is alleviated.

According to one aspect of the invention there is provided a pre-focussed incandescent lamp including a lamp cap, a lamp envelope, one or more filaments in the lamp envelope, lead wires attached to respective filaments extending out of the envelope and sealed within a pinch seal formed as part of the lamp envelope, the pinch seal including V-shaped grooves, a ring-like member of resilient material situated in said V-shaped grooves thereby to be resiliently clamped substantially around the pinch seal and arranged to have substantially only line contact with the interior of the lamp cap, the lamp including means fixing the ring-like member to the lamp cap.

According to further aspect of the invention there is provided a method of manufacturing an incandescent pre-focus lamp comprising the steps of:

providing a lamp envelope with one or more filaments connected to respective lead wires sealed within and extending out at a pinch seal formed on the lamp envelopes, the pinch seal including V-shaped grooves;

providing a lamp cap relative to which said one or more filaments are to be positioned;

providing a ring-like member, adapted, when situated in said V-shaped grooves to have line contact with the interior surface of the lamp cap;

springing said resilient ring-like member into said V-shaped grooves thereby resiliently to clamp the ring-like member substantially around the punch seal;

sliding the lamp envelope complete with said resilient ring-like member resiliently clamped around the pinch seal into the interior of the lamp to a pre-determined depth;

positioning the lamp envelope substantially on the line contact so that one or more filaments are correctly positioned relative to the lamp; and fixing the lamp cap and the ring to each other.

A particular problem with said present design of pre-focussed lamp is that an intermediate member in the form of a cylindrical metal cup member is used to support the lamp bulb in the lamp cap. Initially the lamp bulb is held in lugs bent out of the bottom of the cup member and this assembly is then inserted into the lamp cap and soldered into position. The problem is that the depth of the cup member extending into the lamp cap forms a relatively rigid connection thus making it difficult to get the required play of the lamp bulb within the lamp cap so that the correct alignment of the bulb with the cap can be attained.

By ensuring the intermediate member makes only line contact or substantially line contact with the internal surface of the lamp cap it was appreciated that it would be very much easier to adjust the position of the lamp. Preferably this is achieved by making the intermediate member in the form of a ring, preferably, also, by making the ring of resilient material it can be easily mounted and located on the extension of the lamp envelope in which the lead wires are sealed. Once the lamp bulb has been correctly positioned within the lamp cap it is secured in position, preferably by soldering with heat being applied to the body of the lamp cap.

It is known to use a resilient ring as an intermediate member in order to assist the attachment of a lamp cap to the neck of a lamp bulb and, for example, such an arrangement is disclosed in UK Pat. No. 767,971. In this patent the ring is pressed into a groove on the neck of a GLS lamp as the lamp cap is pressed over the lamp neck during assembly. The arrangement is concerned only with preventing axial withdrawal and in this GLS lamp there is no necessity to be able to adjust the lamp envelope relative to the lamp cap prior to fixing. Consequently an interference fit of the ring relative to the lamp cap is used whereby the ring may be sprung into the groove as the lamp cap is pressed onto the neck. This is in contrast to the present invention where the resilient ring is arranged to be fitted to and be a tight fit on the lamp pinch prior to its insertion into the lamp cap. By arranging that the lamp bulb complete with ring is a sliding fit within the lamp cap the final positioning of the filament is facilitated. Moreover, because the preferred form of the incandescent lamp of the invention operates on the tungsten halogen cycle it is necessary to use materials having a resilience which does not deteriorate with the high temperature associated with operation of tungsten halogen lamps e.g. around 900° C.

Figure 2:
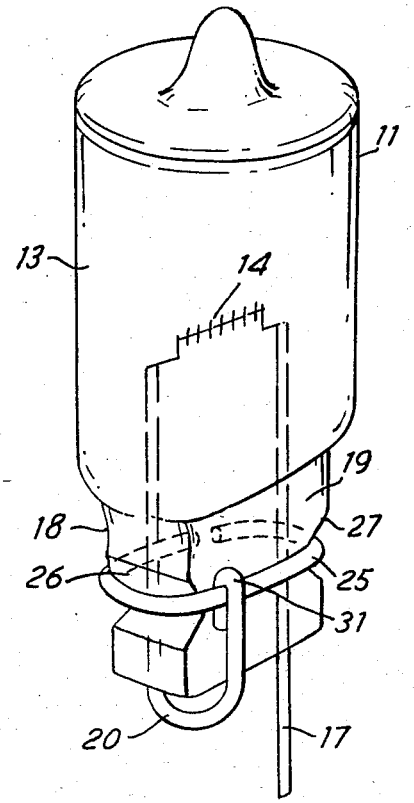
Figure 3:
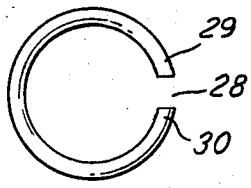
Figure 4:
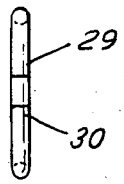
Figure 5:
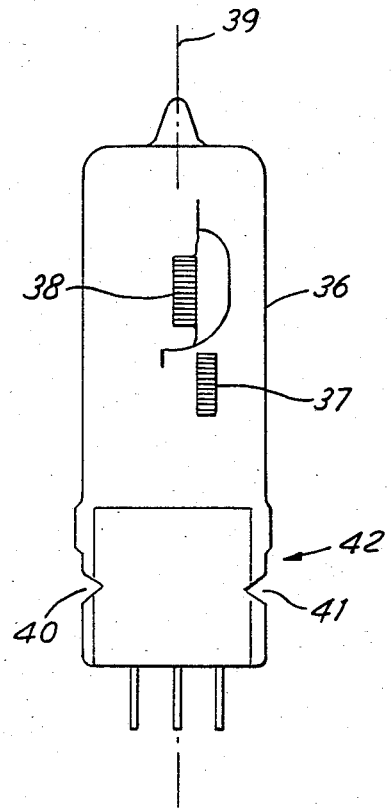
Figure 6:
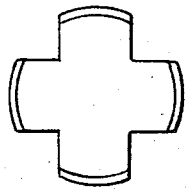

The invention will now be described by way of example only and with reference to the accompanying drawings wherein:

FIG. 1 is a sectional view through one embodiment of a pre-focussed lamp according to the present invention, FIG. 2 is a pictorial view of a lamp bulb used in the embodiment of FIG. 1, FIGS. 3 and 4 are side and elevational views respectively of an intermediate member used in the invention, FIG. 5 is a view of the bulb of another lamp embodying the invention, and FIG. 6 is a view of an alternative section of a lamp extension or pinch seal which can be used to practice the invention.

In FIG. 1, reference numeral 10 denotes a lamp which operates on the tungsten halogen cycle and is for use as a bicycle lamp according to one embodiment of the invention. This comprises a lamp bulb 11 of alumino silicate glass secured within a circular lamp cap 12 of nickel plated brass. Lamp cap 12 has the normal three protrusions placed at 120°, one of which is shown at 120 in FIG. 1 together with the usual notch to give the required location of the lamp cap within a projector housing. The bulb 11 has an envelope 13 in which is situated a single coil tungsten filament 14 which lies transverse to the longitudinal axis 15 of the lamp 10. The filament 14 is carried on composite nickel and molybdenum lead wires 16 and 17 which are pinch sealed at 19 into a rectangular-shaped extension 18 of the envelope 13 having major and minor flat sides as best seen in FIG. 2, with the major side being of substantially the same width on the lamp envelope as best seen in FIG. 1. One of the lead wires 16 is bent upwards at 20, after it emerges from the rectangular pinch seal 19 (for a purpose to be described later) while the other lead wire 17 is attached to a brass contact plate 21 after focussing has taken place. Contact plate 21 is set into a moulded member 22 of the glasslike material Vitrite forming a bottom part 23 of the lamp cap 12. If desired lead wire 17 can be covered with a length of glass reinforced plastic sleeving (not shown) to prevent electrical shorting during the focussing operation and afterwards. An intermediate member 24 in the form of a ring 25 of resilient material, which maintains its resilience at high temperature, for example, electro tin plated spring steel, is sprung over the pinch 19 and resiliently clamped in V-shaped grooves 26 and 27 formed in the pinch seal 19, for example by moulding. It is important that the grooves be V-shaped to provide the three point contact as best seen in the sectional view shown in FIG. 1 and preferably are formed to have an included angle of about 60° to accommodate the ring 25 which ring has a cross section diameter of 22 SWG (0.028") shown partly dotted in FIG. 4. The ring 25 is shown in FIGS. 3 and 4. A typical ring would have an internal diameter of 0.260" and it is important that the ring be a tight fit around the pinch after assembly and before insertion into the lamp cap. A gap 28, typically not more than 0.028", is left between the ends 29 and 30 so that the ring is more easily sprung over the pinch seal 19. Moreover when the lamp bulb 11 with the ring 25 in position is slid onto the lamp cap 12 the gap 28 tends to close, making for easier assembly. As stated earlier one of the lead wires 16 is bent upwards at 20 so that it lies along the flat front of the pinch seal (9) and is placed across the ring 25 and the end 31 bent and tucked inside the resilient ring 25 as best seen in FIG. 2. This ensures that the end 31 of lead wire 16 makes good electrical contact when the lamp bulb assembly is inserted into the lamp cap 12. After the focussing operation, described below, end 31 of wire 16 is soldered in with ring 25 as the solder flows along the ring. Thus the lamp bulb 11 can be lit for testing even though no permanent connections have been made.

The lamp cap 12 has a reference point, for example flange 32, which has a known spatial relationship with the optical axis of a reflector or projector in which the pre-focussed lamp is to be used. By aligning the filament 14 with a reference point which has a predetermined relationship with the flange 32 and thereby with the optical axis of the projector or reflector the lamp 10 can be pre-focussed to the correct position. This can be accomplished as follows.

The lamp cap 12 complete with Vitrite insert 22 and contact plate 21 is placed with the flanged side facing downwards in the chuck of an assembly machine. A lamp bulb 11 complete with resilient ring 25 sprung onto the pinch 19, and lead wires 16 and 17 in position as shown in FIG. 2 is inserted into the lamp cap 12 and held in the assembly machine. The outer diameter of the ring 25 when mounted on the pinch 19 is designed to be a sliding fit within the internal diameter of the lamp cap 12. Prior to the insertion of the lamp bulb 11, a ring 33 of 18 gauge core solder or, alternatively solder paste is deposited within the empty lamp cap 12. This also is designed to be retained within the lamp cap 12 by being sliding fit. Once the lamp is positioned to the required depth by sliding along lamp axis 15 it can be rocked in any direction about the axis formed by the line contact of the ring 25 as best seen in FIG. 1. The rocking movement, for example is depicted by the arrows A shown in FIG. 1 and the lamp bulb can be rotated around the axis if desired. Thus it will be appreciated it is very easy to adjust the position of the lamp bulb 11 so that the filament 14 is correctly aligned with the reference source. Once the lamp bulb 11 is correctly aligned with the reference source heat in the form of gas jets, denoted by 34, is applied to the lamp cap 12. This melts the solder 33 which runs down and forms a fillet 35 on either side of the ring 25 as shown by the shaded part. The lamp bulb 11 is thus firmly secured within the lamp cap 12.

A typical tungsten halogen lamp for a bicycle headlamp as described above would have a lamp envelope diameter of 10 mm and 30 mm total length. A typical filament length would be 1.25 mm and this size of lamp would have a rating of 6 v, 2.4 W.

Although the above embodiment has been described in terms of a glass halogen cycle lamp for a bicycle it will be clear the principle of the invention could be applied to other pre-focussed lamps. One such lamp would be the lamp known as H4 which is a lamp for use in automobile headlights. The quartz bulb only 36, of such a lamp is shown in FIG. 5. A main difference between this lamp and the lamp described above is that it has two filaments 37 and 38 which are aligned axially with the longitudinal axis 39 instead of being transverse to this axis as in the bicycle headlamp. V-shaped grooves 40 and 41 in accordance with the invention as described above are provided in the pinch seal 42. A more detailed description of an H4 lamp is contained in the article "H4 Automobile Lamp Technology" contained in the Lighting Journal 20 which is a publication of THORN EMI Lighting Limited, Upper St. Martin's Lane, London.

Other changes could be made. Instead of a rectangular shaped pinch seal a cruciform shape shown in FIG. 6 could be used. Moreover instead of soldering the intermediate member some form of joining by welding could be used.

We claim:

1. A pre-focussed incandescent lamp including a lamp cap, a lamp envelope, one or more filaments in the lamp envelope, lead wires attached to respective filaments extending out of the envelope and sealed within a pinch seal formed as part of the lamp envelope, the pinch seal being grooved to receive a ring-like member of resilient material, said ring like member being clamped substantially around the pinch seal thereby preventing relative movement between the pinch seal and the ring like member and arranged to have substantially only line contact with the interior of the lamp cap, the lamp including means fixing the ring-like member to the lamp cap.

2. A pre-focussed incandescent lamp according to claim 1 wherein the pinch seal comprises a rectangular pinch seal.

3. A pre-focussed incandescent lamp according to claim 1 wherein one of the lead wires is bent out of its alignment within the pinch seal to contact at least a part of the ring-like member thereby making electrical contact with the ring-like member and with the lamp cap.

4. A pre-focussed incandescent lamp according to claim 3 wherein the lead wire is bent to lie along a flat part of the pinch seal.

5. A pre-focussed incandescent lamp according to claim 1 wherein the grooves are V-shaped.

6. A pre-focussed incandescent lamp according to claim 5 wherein the grooves have an included angle of substantially 60°.

7. A pre-focussed tungsten halogen incandescent lamp including a lamp cap, a lamp envelope, one or more filaments in the lamp envelope, lead wires attached to respective filaments extending out of the envelope and sealed within a pinch seal formed as part of the lamp envelope, the pinch seal being grooved to receive a ring-like member of resilient material which maintains its resilience at the operating temperature of the lamp, said ring-like member being clamped substantially around the pinch seal to prevent relative movement between the pinch seal and ring-like member and arranged to have substantially only line contact with the interior of the lamp cap, the lamp including means fixing the ring-like member to the lamp cap.

8. A pre-focussed incandescent lamp according to claim 1 wherein the ring-like member is a split ring having a substantially circular cross section.

9. A pre-focussed tungsten halogen incandescent lamp according to claim 7 wherein the ring-like member is a split ring having a substantially circular cross-section.

10. A pre-focussed incandescent lamp including:

a lamp envelope having a rectangular pinch seal formed with respective flat sides, the lamp envelope including therein one or more filaments with lead wires attached to respective filaments, the lead wires being sealed within the pinch seal and extending out of the pinch seal, the pinch seal including a groove formed in a selected two of said respective flat sides;

a ring-like member having at least a partly radiused surface situated in said grooves and clamped substantially around the pinch seal and thereby forming an assembly with said lamp envelope;

a lamp cap surrounding the ring-like member making only line contact with said partly radiused surface, one of the lead wires being bent out of its alignment within the pinch seal to lie along a flat side other than said selected two flat sides, and make electrical contact with said resilient ring and thereby said lamp cap.

11. A pre-focussed incandescent lamp having a longitudinal axis, said lamp including a lamp cap, a lamp envelope, one or more filaments in the lamp envelope and lead wires attached to respective filaments extending out of the envelope, the lead wires being sealed within a pinch seal formed as part of the lamp envelope, a ring like member clamped around the pinch seal to substantially prevent relative movement between the pinch seal and the ring like member thereby forming an assembly, said ring like member having at least a partly radiused surface arranged to make substantially only line contact with the inside surface of the lamp cap such that said assembly is capable of a rocking movement about an axis formed by said line contact, said lamp including means fixing said assembly to the lamp cap to prevent said rocking movement.

12. A pre-focussed lamp according to claim 11 wherein the pinch seal is grooved to receive the ring like member.

13. A pre-focussed lamp according to claim 11 wherein the ring like member is made of a resilient material which maintains its resilience at the operating temperature of the lamp.

14. A method of manufacturing a pre-focussed incandescent lamp including the steps of:

providing a lamp envelope with one or more filaments connected to respective lead wires sealed within and extending out of a pinch seal formed on the lamp envelope;

providing a lamp cap relative to which said one or more filaments are to be positioned;

providing a ring-like member having at least a partly radiused surface, adapted, when situated on said pinch seal to have only line contact with the interior surface of the lamp cap;

springing said ring-like member around the pinch seal thereby to clamp the ring-like member substantially around the pinch seal to substantially prevent relative movement between the pinch seal and the ring-like member;

moving the lamp envelope complete with said ring-like member clamped around the pinch seal relative to the interior of the lamp cap to a pre-determined depth;

and positioning the lamp envelope substantially about the line contact so that said one or more filaments are correctly positioned relative to the lamp cap; and fixing the lamp cap and the ring to each other.

15. A method of manufacturing a pre-focussed incandescent lamp according to claim 8 including bending one of the lead wires out of its alignment within the pinch so that it can make electrical contact with the ring-like member.

16. A method of manufacturing a pre-focussed incandescent lamp according to claim 8 including the step of depositing solder within the lamp cap prior to moving the lamp envelope complete with ring-like member into the lamp cap and heating the lamp cap to fix the lamp cap and the lamp envelope relative to each other.

17. A method of manufacturing a pre-focussed incandescent lamp according to claim 14 wherein the ring-like member is a split ring of substantially circular cross section.

18. A method of manufacturing a pre-focussed incandescent lamp according to claim 14 wherein the pinch seal is grooved to receive the ring like member.

* * * * *